United States Patent [19]

Mar

[11] Patent Number: 5,003,653

[45] Date of Patent: Apr. 2, 1991

[54] SEAT ASSEMBLY

[76] Inventor: Shih L. Mar, 5F-1, No. 212, Ching Hsing Rd., Taipei, Taiwan

[21] Appl. No.: 564,579

[22] Filed: Aug. 9, 1990

[51] Int. Cl.[5] ..... A47C 27/08

[52] U.S. Cl. ..... 5/449; 5/441; 5/455; 297/DIG. 3

[58] Field of Search ..... 5/441, 442, 449, 455, 5/448, 465; 297/DIG. 3

[56] References Cited

U.S. PATENT DOCUMENTS

| | | | |
|---|---|---|---|
| 2,216,818 | 10/1940 | Kuhlman | 5/449 |
| 2,689,812 | 9/1954 | Mollica | 5/449 |
| 2,718,014 | 9/1955 | Mizrach | 5/449 |
| 3,125,377 | 3/1964 | Bridges | 297/DIG. 3 |
| 3,265,438 | 8/1966 | Regan | 297/DIG. 3 |
| 3,513,489 | 5/1970 | Miller | 5/449 |
| 3,644,949 | 2/1972 | Diamond | 5/441 |
| 4,054,960 | 10/1977 | Pettit | 5/455 |
| 4,504,989 | 3/1985 | Maltz | 5/455 |

FOREIGN PATENT DOCUMENTS

| | | | |
|---|---|---|---|
| 2035787 | 2/1972 | Fed. Rep. of Germany | 5/449 |
| 101140 | 11/1962 | Norway | 5/449 |

*Primary Examiner*—Gary L. Smith
*Assistant Examiner*—F. Saether
*Attorney, Agent, or Firm*—Rogers, Howell & Haferkamp

[57] ABSTRACT

A seat assembly comprising generally an outer air cushion and an inner air cushion provided therein. The outer air cushion includes three rings superposed and fixed together, each ring having an air tap. A diameter of the lower ring, when taken in cross section, is larger than a diameter of the upper ring which is larger than a diameter of the middle ring. The inner air cushion is expanded and is limited within the outer air cushion when a user is seated thereon. The inner air cushion completely absorbs a weight of the user and is deformed according to a body of the user so that the user may feel comfortable.

1 Claim, 6 Drawing Sheets

SEAT ASSEMBLY

BACKGROUND OF THE INVENTION

The present invention relates to a seat assembly, and more particularly to a seat assembly capable of undulation when subject to pressure due to a user sitting thereon.

The closest prior art of which the inventor is aware is his prior U.S. Pat. No. 4,830,345 (Shih L. Mar, "A spring-loaded seat assembly", Ser. No. 122,441, filed Nov. 19, 1987). The seat assembly employs spring members which may exert a resilient force to a user who is seated thereon.

SUMMARY OF THE INVENTION

The primary objective of the present invention is to provide a seat assembly which employs air cushions, the air cushions completely absorb the load or the weight of the user who is seated thereon and are deformed according to the body of the user so that the user may feel more comfortable.

In accordance with one aspect of the invention, there is provided a seat assembly which comprises an outer air cushion and an inner air cushion provided therein. The outer air cushion includes three rings superposed and fixed together, each ring has an air tap. A diameter of the lower ring, when taken in cross section, is larger than a diameter of the upper ring which is larger than a diameter of the middle ring. The inner air cushion expands within the outer air cushion when a user is seated thereon. The inner air cushion completely absorbs a weight of the user so that the user may feel comfortable.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
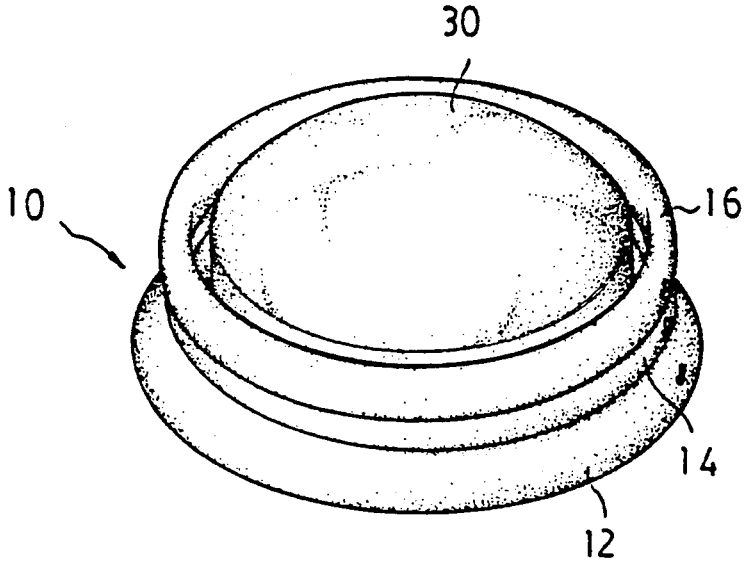
FIG. 1 is a perspective view of a seat assembly in accordance with the present invention.

Referring to the drawings and initially to FIG. 1, the seat assembly in accordance with the present invention comprises generally an outer air cushion 10, and an inner air cushion 30 provided therein.

Figure 2:
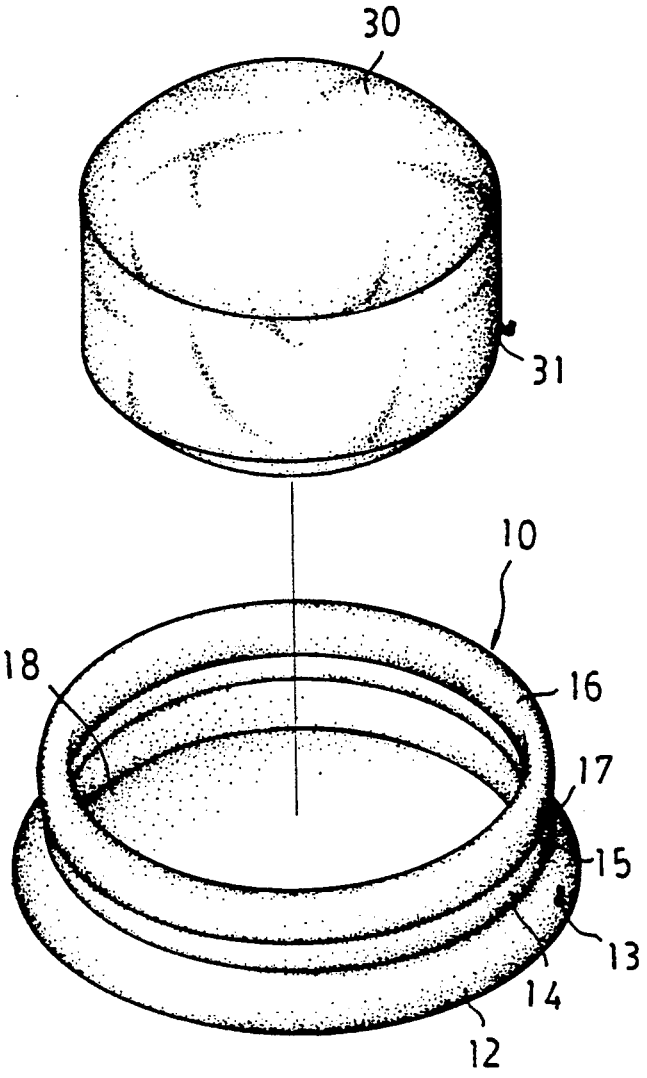
FIG. 2 is an exploded view of the seat assembly.
Figure 3:
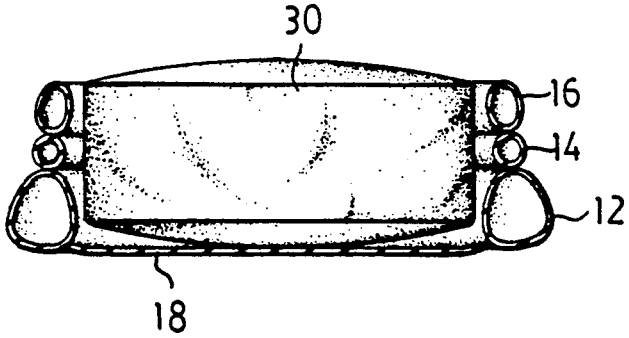
FIG. 3 is a cross sectional view of the seat assembly taken along lines 3—3 of FIG. 1.
Figure 4:
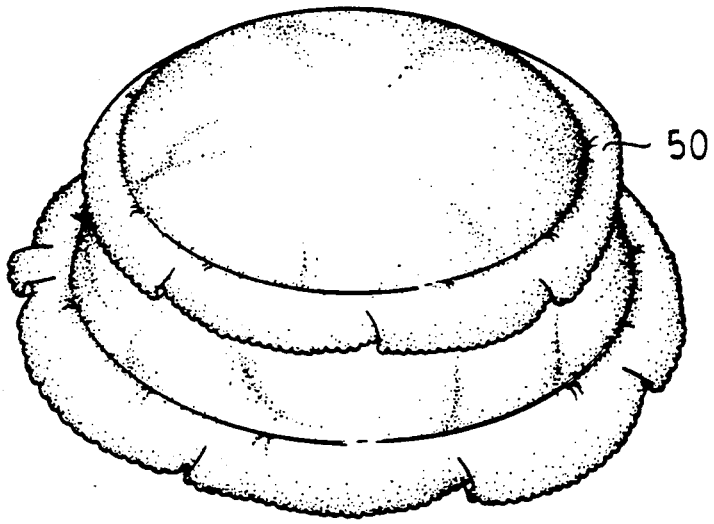
FIG. 4 is a perspective view embodying the present invention.

Referring next to FIGS. 2, 3 and 4, the outer air cushion 10 comprises three ring portions including a lower ring 12, a middle ring 14, and an upper ring 16 superposed and fixed together. Each ring 12, 14, 16 has an air tap 13, 15, 17. A base 18 which is a sheet member is provided in and fixed to the lower end of the lower ring 12. As shown in FIG. 3, the diameter of the lower ring 12, when taken in cross section, is preferably larger than the diameter of the upper ring 16 which is preferably larger than the diameter of the middle ring 14. The large diameter of the lower ring 12 provides a stable configuration for the seat assembly. The inner air cushion 30 has an outer diameter less than the inner diameters of the ring portions 12, 14, 16 and has a height approximately equal to the height of the ring portions. As shown in FIG. 4, the seat assembly in accordance with the present invention is upholstered with a cover 50.

Figure 5:
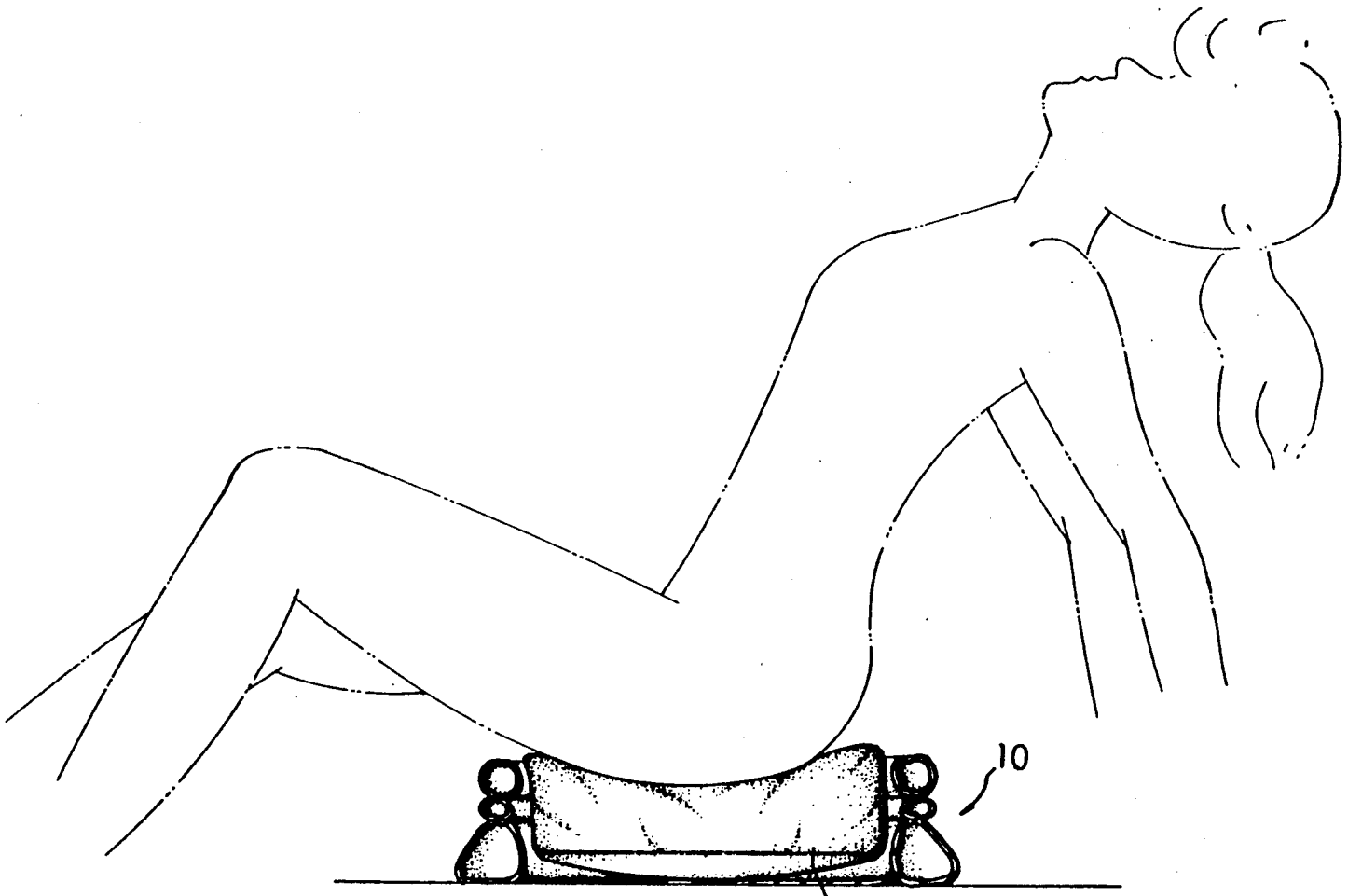
FIGS. 5 and 6 are cross sectional views similar to FIG. 3, illustrating two working conditions of the present invention.
Figure 6:
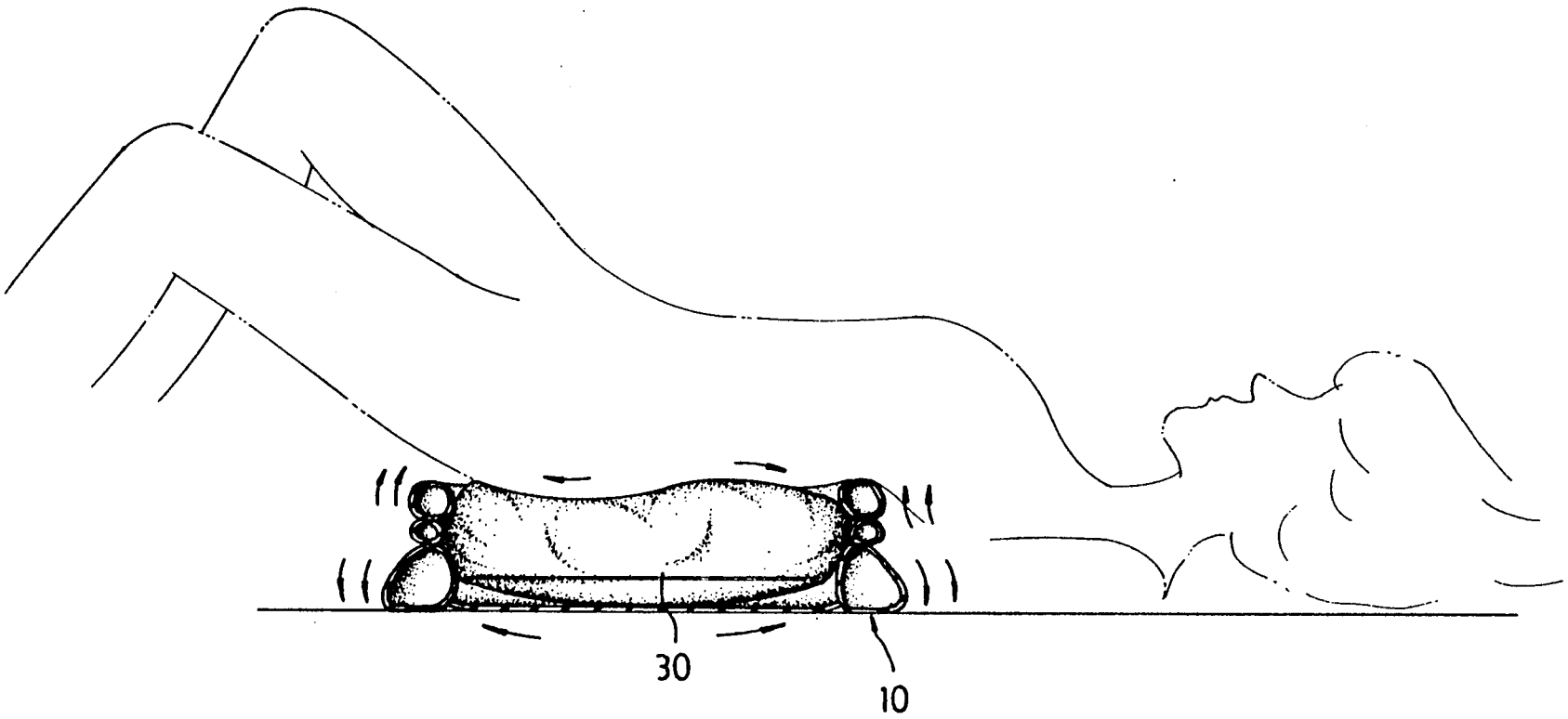

Referring next to FIGS. 5 and 6, when in use, both outer air cushion 10 and inner air cushion 30 are preferably inflated to a volume about 60% of the volume when fully inflated. When a user is seated on the seat assembly, the inner air cushion 30 completely absorbs the load or the weight of the user, and the upper surface of the inner air cushion 30 is depressed and deformed according to the body of the user. The user may feel more comfortable than sitting on the seat assembly which employs spring members. The lower portion of the inner air cushion 30 is inflated or expanded, and the inner air cushion 30 has a tendency to be inflated such that the outer diameter of the middle peripheral portion which is located close to the lower peripheral portion and the upper peripheral portion, as shown in FIG. 6. The user who is seated on or lies on the inner air cushion 30 can move horizontally back and forth easily. The user may sway or undulate by his/her own will.

Accordingly, the seat assembly in accordance with the present invention will not undulate automatically and will not exert a resilient force to the user. The user may undulate by his/her own will. The user may feel more comfortable than sitting on the seat assembly which employs spring members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A seat assembly comprising generally an outer air cushion and inner air cushion provided therein; said outer air cushion including three rings superposed and fixed together, each ring having an air tap; a diameter of said lower ring, when taken in cross section, being larger than a diameter of said upper ring which is larger than a diameter of said middle ring; said inner air cushion being expanded and being limited within said outer air cushion when a user is seated thereon; and said inner air cushion completely absorbing a weight of said user and being deformed according to a body of said user so that said user may feel comfortable.

* * * * *